US005777286A

United States Patent [19]

Abot et al.

[11] Patent Number: 5,777,286

[45] Date of Patent: Jul. 7, 1998

[54] ELECTRIC DEVICE HAVING SEPARABLE CONTACTS WITH ARC SWITCHING

[75] Inventors: Jean Abot, L'isle Adam; Michel Ledroit, Yerres; Nicolas Hertzog, Rueil Malmaison, all of France

[73] Assignee: Schneider Electric SA, Boulogne Billancourt, France

[21] Appl. No.: 773,534

[22] Filed: Dec. 23, 1996

[30] Foreign Application Priority Data

Dec. 21, 1995 [FR] France ..... 95 15464

[51] Int. Cl.[6] ..... H02H 3/00

[52] U.S. Cl. ..... 218/36; 218/40; 361/8

[58] Field of Search ..... 218/8, 15, 22, 218/29, 30, 31, 34, 36, 40, 148; 361/2, 3, 8, 10, 12, 13, 94

[56] References Cited

U.S. PATENT DOCUMENTS 4,725,911 2/1988 Dieppedalle et al. ..... 361/8

5,410,442 4/1995 Pohl et al. ..... 361/94

FOREIGN PATENT DOCUMENTS 0 104 981 4/1984 European Pat. Off. .

0 205 369 12/1986 European Pat. Off. .

0 255 992 12/1986 European Pat. Off. .

0 350 825 1/1990 European Pat. Off. .

0 589 779 3/1994 European Pat. Off. .

*Primary Examiner*—Khanh Dang

*Attorney, Agent, or Firm*—Oblon, Spivak, McClelland, Maier & Neustadt, P.C.

[57] ABSTRACT

An electrical device for switching an arc to a path parallel to a device to be protected. The electrical device includes double breaking contacts and an arc transfer electrode associated with the parallel path. The parallel path shunts the double breaking contacts and a device to be protected via the arc transfer electrode. The arc transfer electrode is placed in the vicinity of a fixed contact of the double breaking contacts.

6 Claims, 1 Drawing Sheet

ELECTRIC DEVICE HAVING SEPARABLE CONTACTS WITH ARC SWITCHING

BACKGROUND OF THE INVENTION

1. Field of the Invention

This invention relates to an electric device with separable contacts such as a contactor, circuit breaker, limiter or contactor circuit breaker, capable of being connected to a load through a main conducting path comprising a control or protection device, this device also including a parallel conducting path for the control or protection device, this path capable of being brought into play by switching of a breaking arc.

2. Discussion of the Background

This type of device described in document EP-104 981 comprises a main current path fitted with a magnetothermal trip, with single breaking separable contacts, and an electronic switch placed in series with the contacts and which can be shunted by a parallel path. When a high overcurrent passes along the main path, the trip will open contacts; at the same time an arc will be initiated between the contacts, and is then immediately transferred to the parallel path such that the electronic load switch remains protected during the contact opening phase.

It would be desirable for some applications to use this type of arc switching while benefiting from the breaking quality of a double breaking device.

Document EP-589 779 describes a double breaking electromechanical device using a mobile bridge equipped with "supply side" separable contacts on the power supply source side, and "load side" separable contacts on the same side as the load, this circuit breaker using a parallel path as defined above. However this known type of circuit breaker has the disadvantage that when a breaking arc occurs, the parallel current path shunting the device to be protected reduces the arching voltage between the supply side breaking points and load side breaking points, which causes an increase in the impedance which could initiate a new arc on the main current path.

SUMMARY OF THE INVENTION

The purpose of this invention is to increase the impedance of the main conducting path when contacts are opened in a double breaking electrical device with a parallel path activated by arc switching.

The device according to the invention comprises a supply side arc transfer electrode placed immediately adjacent to the supply side contacts, to collect an initiating arc on the supply side immediately that contacts are opened, this electrode being connected to a parallel path that shunts load side contacts and the mobile bridge. The result is that the impedance of the load side arc which appears in the main conducting path facilitates switching of the arc towards the parallel path.

BRIEF DESCRIPTION OF THE DRAWINGS

The following description of an embodiment of the invention is made with reference to the drawings.

DESCRIPTION OF THE PREFERRED EMBODIMENTS

Figure 1:
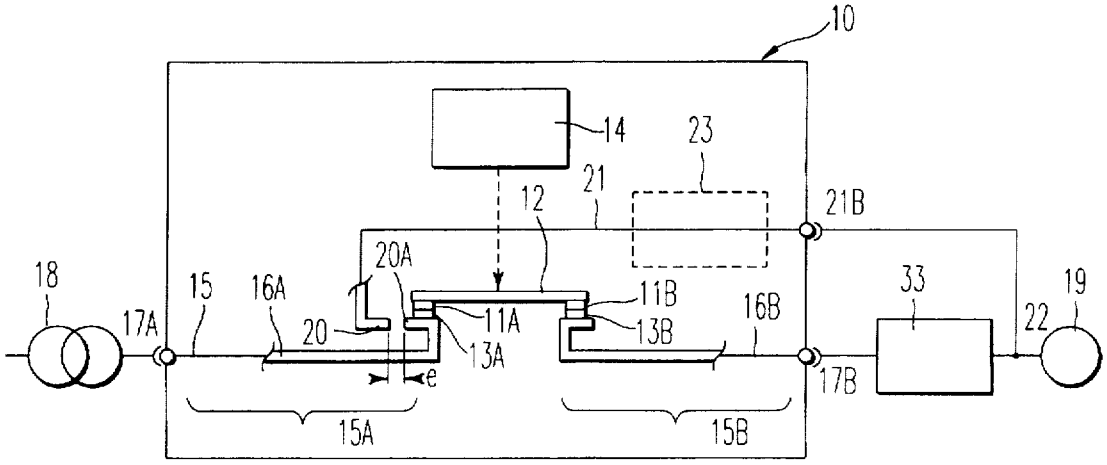
FIG. 1 diagrammatically illustrates an electrical device with separable contacts according to the invention, in the closed state.

The electrical arc switching device illustrated on FIG. 1 forms part of an electrodynamic limiter type of protecting device or is incorporated in a contactor, circuit breaker, contactor-circuit breaker or starter type of device including two load side and supply side mobile contacts 11A, 11B located on a mobile contact bridge 12 located in a housing 10, each capable of cooperating with fixed load side and fixed supply side contacts 13A and 13B respectively. The contacts may be controlled by a control device 14, for example consisting of a contactor electromagnet, a circuit breaker lock or by a manual control device acting on bridge 12 via a drive part not shown, or by electrodynamic opening devices.

The device includes a main current path 15 which is set up when the contacts are closed. This main path includes the mobile bridge 12 and two parts 15A, 15B located on the supply side and load side of the bridge respectively and including conducting parts 16A, 16B, which firstly carry fixed contacts 13A, 13B, and secondly terminals 17A, 17B respectively, in this example formed by the external connection terminals. The side of the device connected to a power source 18 is referred to as the "supply side" and the side of the device connected to a load 19 via a control or protective device 33 to be protected against the effects of short circuit or breaking overcurrent, is called the "load" side.

Figure 2:
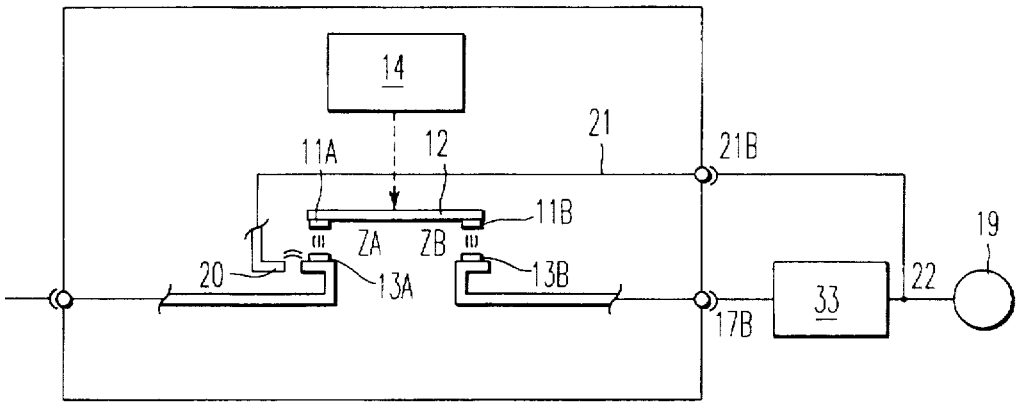
FIG. 2 shows the same device while the contacts are opening under the effect of a fault current.

The device according to the invention includes an arc transfer electrode 20 associated with the supply side contacts 11A, 13A and located at a short distance from the fixed contact 13A to collect the initiating arc associated with the fixed contact, when the contacts open (see FIG. 2). The electrode 20 is separate from the j-shaped end 20A of the fixed conducting part 16A on the main current path 15 by a small fixed space e, sufficiently large to provide the required isolating distance during normal operation, but sufficiently small to be crossed by the bottom of the load side arc generated during a break caused by a fault. The electrode 20 is well insulated from part **16*a* and is connected by an electrically conducting path 21 in parallel with the load side contacts 11B, 13B, to a connection point 22 located on the current line on the load side of device 33 to be protected, to set up a parallel path for the load when a break occurs, using the supply side arc only. Depending on the case, the link between electrode 20 and connection point 22 is made by external wiring using a connection terminal 21B** external to the device (FIGS. 1 and 2), or by a link internal to the device (FIG. 3).

The impedances ZA, ZB between supply side contacts 11A, 13A and load side contacts 11B, 13B respectively are negligible when the contacts are closed. When the contacts open and arc phenomena occur, supply side and load side voltage drops increase impedances ZA, ZB; starting from a current threshold, the supply side arc that occurs between contacts 13A and 11A is switched to electrode 20, jumping over the fixed gap e (see FIG. 2) to appear between fixed contact 13A (or the corresponding area in the fixed contact part) and electrode 20, whereas impedance ZB increases until it reaches an infinite value. Note that the supply side arc transferred between the fixed contact part and electrode 20 reduces the electrothermal load on the supply side mobile contact 11A and the mobile bridge. A fixed or variable impedance 23 of value ZC (for example a simple resistance or a resistance with a positive temperature coefficient) may be inserted on the parallel path, as shown in dashed lines on FIG. 1.

Figure 3:
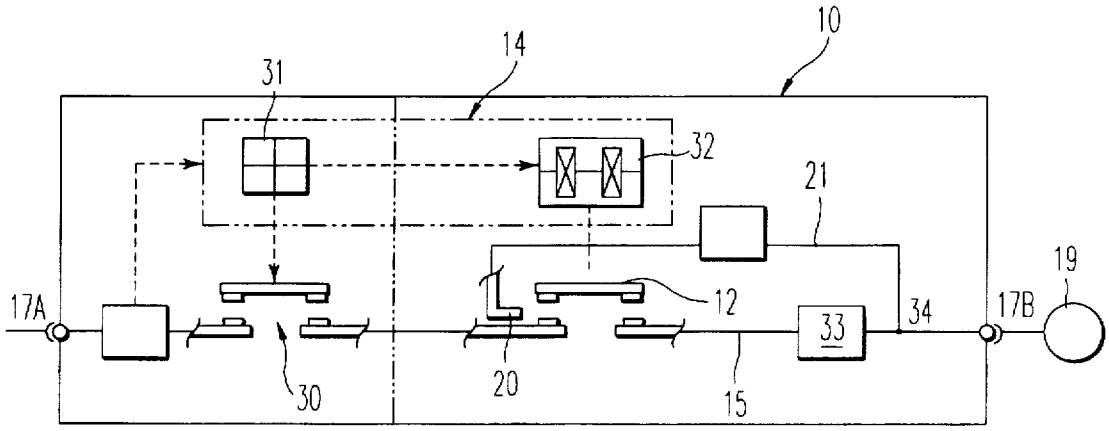
FIG. 3 shows an alternative embodiment of the device.

In the alternative illustrated on FIG. 3, the device is built into a device housing 10 comprising another double break mobile bridge 30 on the supply side controlled by a lock 31 on the circuit breaker that forms part of the control device 14, or which may be independent if the circuit breaker housing is separate from housing 10 (as shown by the separation in chain dotted lines).

Lock 31 cooperates with an electromagnet 32 which belongs to device 14 and which controls the mobile bridge 12 to open contacts 11, 13 by deliberate control, or when an overvoltage is determined by lock 31 being opened. The protected load may then consist of an internal switching or gradually starting electronic device 33. The load side connection point 34 between the parallel path 21 and the main path 15 is then located in housing 10.

The device described with reference to FIGS. 1 and 2 works as follows:

When an overcurrent occurs in the main current path, the detector means not shown act on control means 14 which cause mobile bridge 12 to open, initiating an arc on the supply side between contacts 11A, 13A, and an arc on the load side between contacts 11B, 13B. Arc voltage drops introduce a supply side impedance ZA and a load side impedance ZB respectively in the main current path; the bottom of the supply side arc associated with the fixed contact 13A is forced towards electrode 20 by extinction means not shown, such that impedance ZA is inserted in the parallel path 21, whereas impedance ZB remains in the main path 15 and becomes infinite.

This gives a cleaner transfer of the current towards the parallel path, while eliminating the risk of the main path being resumed.

What is claimed as new and desired to be secured by Letters Patent of the United States is:

1. An electrical arc switching device, comprising:

a main conductor path divided into a supply side part and a load side part;

a fixed supply side contact connected to said supply side part;

a fixed load side contact connected to said load side part;

a mobile bridge having supply side and load side contacts configured to connect respectively with said fixed supply side and fixed load side contacts;

a mobile bridge opening device for moving the mobile bridge and opening the supply side and load side contacts from the fixed contacts;

a parallel current path; and an arc transfer electrode connected to said parallel current path that shunts the mobile bridge when the supply side and load side contacts are opened, said arc transfer electrode comprising a fixed gap between said fixed supply side contact and said parallel current path.

2. The device according to claim 1 further comprising:

a load side terminal connected to said load side part via one of a control device and a protection device.

3. The device according to claim 2, further comprising:

an internal connection point connected to said load side terminal and connected to said parallel current path.

4. The device according to claim 1, further comprising:

a load side terminal connected to said load side part; and a supply side terminal connected to said supply side part.

5. The device according to claim 4, further comprising:

an external connection path terminal connected to said parallel current path.

6. The device according to claim 5, further comprising:

a power source connected to said supply side terminal;

one of a control device and a protection device connected to said load side terminal; and a load connected to said one of a control device and a protection device at a connection point;

wherein said external connection path is connected to said load at said connection point.

* * * * *